US008499482B1

(12) United States Patent
Di Trolio

(10) Patent No.: US 8,499,482 B1
(45) Date of Patent: Aug. 6, 2013

(54) AMBIDEXTROUS THUMB SAFETY

(75) Inventor: Lucio Di Trolio, Mineola, NY (US)

(73) Assignee: Kimber IP, LLC, Yonkers, NY (US)

( * ) Notice: Subject to any disclaimer, the term of this patent is extended or adjusted under 35 U.S.C. 154(b) by 0 days.

(21) Appl. No.: 13/494,488

(22) Filed: Jun. 12, 2012

(51) Int. Cl.
*F41A 17/00* (2006.01)

(52) U.S. Cl.
USPC ..... 42/70.01; 89/148

(58) Field of Classification Search
USPC ..... 42/70.01, 70.04, 70.05, 70.06, 70.08; 89/142, 148
See application file for complete search history.

(56) References Cited

U.S. PATENT DOCUMENTS 3,492,748 A * 2/1970 Swenson ..... 42/70.01
4,414,769 A * 11/1983 Mueschke ..... 42/70.01
5,212,327 A * 5/1993 Schuemann ..... 42/70.01
8,127,481 B2 * 3/2012 Rozum et al. ..... 42/70.08
2012/0291326 A1 * 11/2012 Bova ..... 42/70.06

FOREIGN PATENT DOCUMENTS

GB 2137324 A * 10/1984

* cited by examiner

*Primary Examiner* — Gabriel Klein
(74) *Attorney, Agent, or Firm* — Caesar, Rivise, Bernstein, Cohen & Pokotilow, Ltd.

(57) ABSTRACT

An ambidextrous safety for a firearm includes a first portion, a second portion and a pivot pin, where each portion has a thumb lever that is rotatable in a frame aperture about the pivot pin having a first end and a second end. The first end is integrally disposed on the first portion and the second end has a first part of a two-part fastener. The second portion has a second part of the two-part fastener. The fastener rigidly secures the first portion to the second portion through the aperture. One part of the fastener has a socket and the other part has a protuberance for receipt in the socket. The protuberance is oblong and tapers inwardly. The socket has a socket aperture having a cutaway, tapering inwardly for receipt of the protuberance. The socket and the protuberance provide an interference fit. The two-part fastener provides retention and minimizes backlash.

2 Claims, 6 Drawing Sheets

AMBIDEXTROUS THUMB SAFETY

BACKGROUND OF THE INVENTION

The present invention is directed to a safety for firearms. More particularly, the present invention is directed to an ambidextrous safety for firearms such as pistols.

A safety is a mechanism used to help prevent the accidental discharge of a firearm to help ensure safe handling. External safeties that allow a user to manually maneuver a lever to an "on" or "off" position are common. In the past, such levers were on the left side of the firearm such that they provided quick and easy use by a user's right hand thumb for right handed use. Some of those firearms allowed for removal of the safety and reinstallation of the safety on the right side of the firearm for left handed use. However, ambidextrous manual safeties are also known that provide a lever on both sides of the firearm for use by either a left or right hand thumb.

Such two sided ambidextrous safeties must typically be made in two parts that are fastened together. However, when fastened together, "backlash" or looseness of the two parts of the safety is a problem. It would be desirable to provide a safety having two parts in a small, compact device that provides good retention of the two parts and minimizes backlash of the two parts relative to one another.

BRIEF SUMMARY OF THE INVENTION

A firearm having an ambidextrous safety is provided. The firearm includes a firearm frame having a left side, a right side, and a handle portion. The frame has a safety aperture extending collinearly from the left side to the right side of the frame. The safety is rotatably disposed in the safety aperture and includes a first portion, a second portion and a pivot pin. Each of the first portion and the second portion has a thumb lever rotatable relative to the frame about an axis of the pivot pin. The pivot pin is disposed perpendicular to a plane of rotation of the thumb levers. The pivot pin has a first end and a second end. The first end is integrally disposed on one of the first portion and the second portion and the second end has a first part of a two-part fastener. The second portion has a second part of the two-part fastener. The fastener rigidly secures the first portion to the second portion through the aperture.

One part of the two-part fastener has a socket and another part of the two-part fastener has a protuberance for receipt in the socket. The protuberance extends from its respective thumb lever and is oblong in cross section in the plane of the thumb lever and tapers inwardly away from its respective thumb lever. The socket has a socket aperture having a tapered cutaway section, tapering inwardly toward its respective thumb lever for receipt of the protuberance. The socket and the protuberance provide an interference fit. The socket and the protuberance provide the two-part fastener which provides retention and minimizes backlash of the first portion relative to the second portion of the safety. The aperture in the frame may be keyed to the protuberance to retain the two first and second portions of the safety in the frame.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiments, but it should be understood that the present invention is not deemed to be limited thereto.

Figure 1:
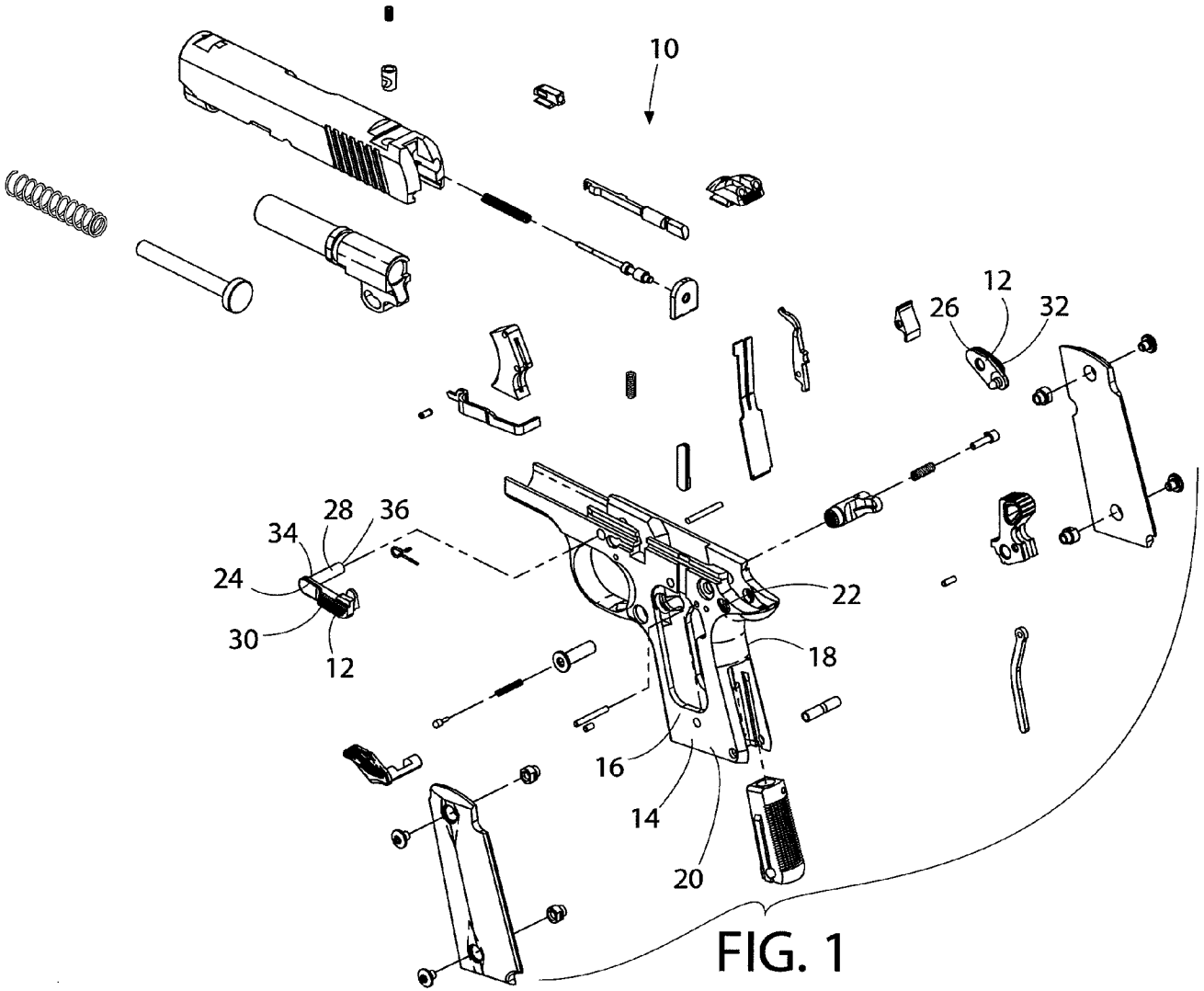
FIG. 1 is an exploded isometric view of a firearm having an ambidextrous safety in accordance with an exemplary embodiment of the present invention.
Figure 2:
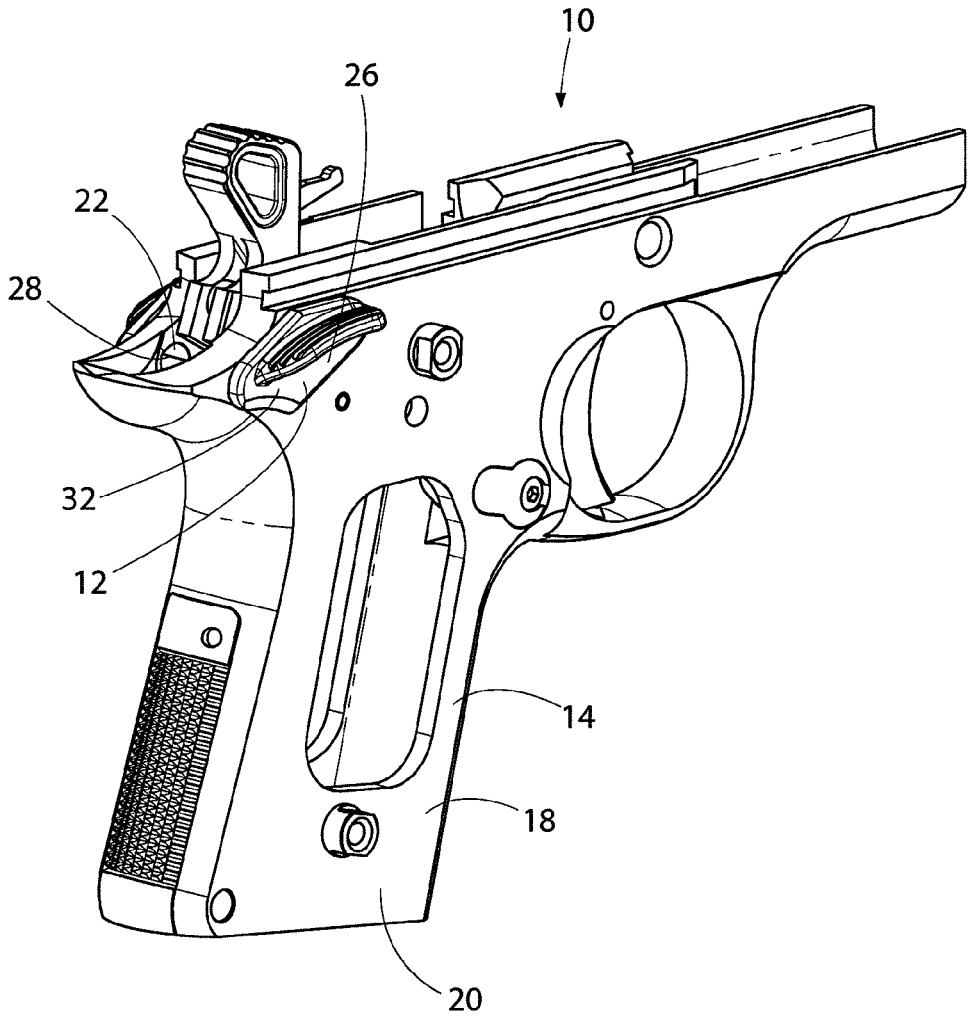
FIG. 2 is a side isometric view of the firearm of FIG. 1, with the slide, grips and other components removed for clarity.

Referring now to the drawing figures, wherein like part numbers refer to like elements throughout the several views, there is shown in FIG. 1 an exploded view of a firearm 10 having an ambidextrous safety 12 in accordance with an exemplary embodiment of the present invention. FIGS. 2, 3A, 3B, and 4 show various views of portions of the firearm 10.

The firearm 10 has a firearm frame 14 having a left side 16, a right side 18, and a handle portion 20. In the frame, there is a safety aperture 22, extending from the left side to the right side of the frame. The safety aperture 22 can be a plurality of apertures that extend collinearly through various walls or surfaces of the frame 14.

Figure 5A:
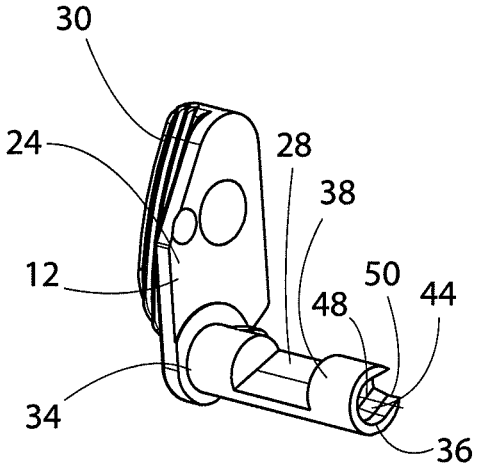
FIG. 5A is an isometric view of a first portion of the safety of the firearm of FIG. 1.
Figure 5B:
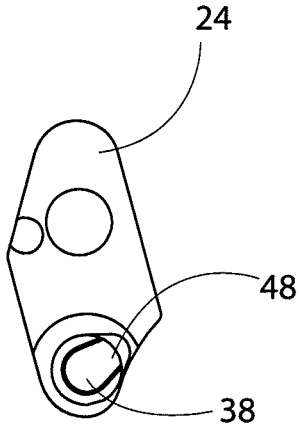
FIG. 5B is a side view of the first portion of the safety of FIG. 5A.
Figure 5C:
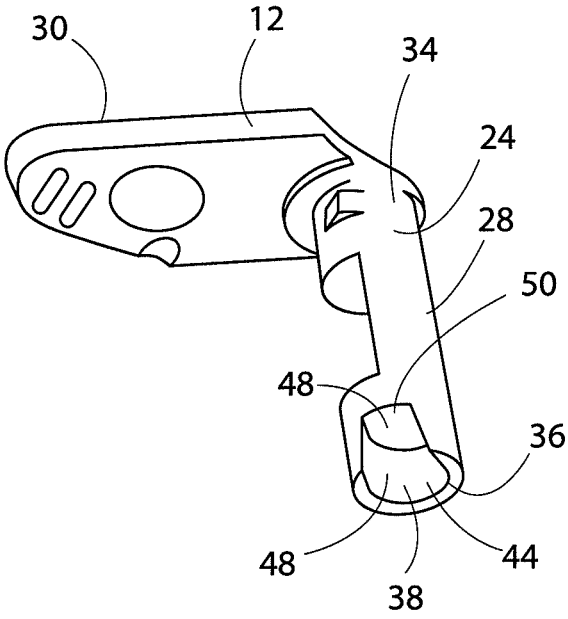
FIG. 5C is an alternate isometric view of the first portion of the safety of FIG. 5A.
Figure 5D:
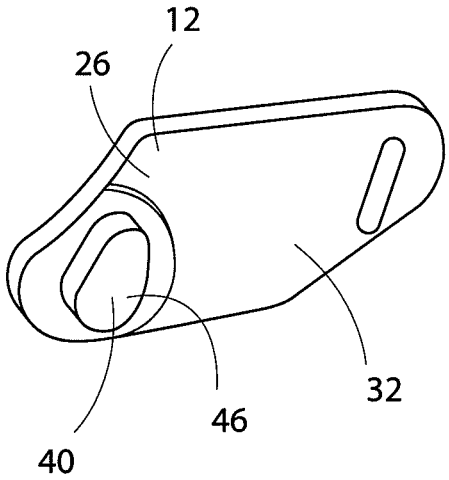
FIG. 5D is an isometric view of the second portion of the safety of the firearm of FIG. 1.
Figure 5E:
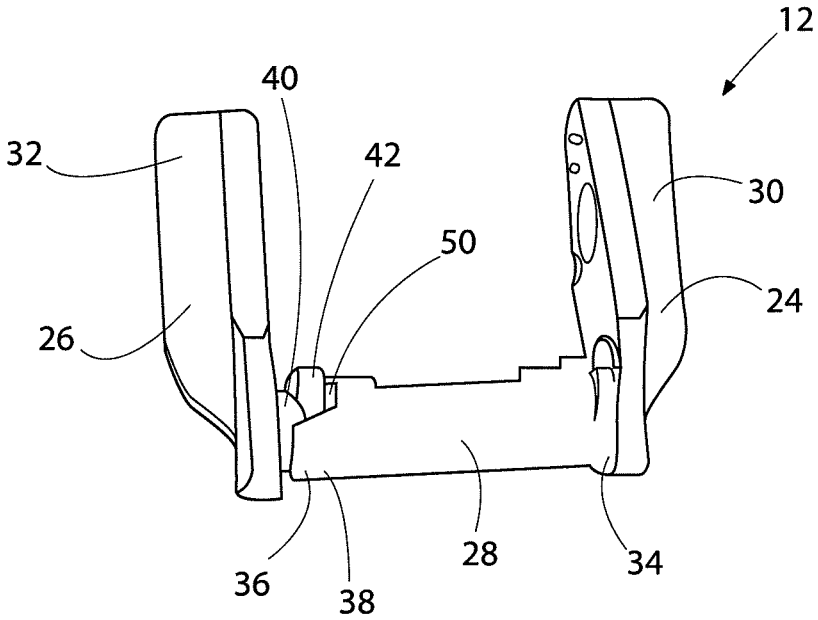
FIG. 5E is an isometric view of the safety of the firearm of FIG. 1, shown with its two portions assembled together, but not assembled in the frame of the firearm.

The safety 12 (see FIG. 5E) is rotatably disposed in the safety aperture 22 in the frame 14. The safety 12 includes two parts, a first portion 24 (see FIGS. 5A and 5B) and a second portion 26 (see FIGS. 5C and 5D) connected by a pivot pin 28. Each of the first portion 24 and said second portion 26 has a thumb lever 30, 32 rotatable about an axis X of the pivot pin 28. The pivot pin 28 is disposed perpendicular to one of the planes of rotation Y of the thumb levers. The pivot pin 28 has a first end 34 and a second end 36. The first end 34 is integrally disposed on one of the first portion 24 and the second portion 26. The second end 36 has a first part 38 of a two-part fastener 42. The second portion 26 has a second part 40 of the two-part fastener 44. The fastener 42 rigidly secures the first portion 24 to the second portion 26 through the aperture 22 of the frame 14.

One part of the two-part fastener 42 has a socket 46 and another part of said two-part fastener 42 has a protuberance 46 for receipt in the socket 44. The protuberance 46 extends from the respective thumb lever 30 (or 32) and is oblong in cross section (see FIG. 5D) in the plane of the thumb lever and tapers inwardly away from the respective thumb lever 30 (or 32).

The socket 44 has a socket aperture 48 having a tapered cutaway section 50, tapering inwardly toward the respective thumb lever (30 (or 32) for receipt of the protuberance 46. The socket 44 and the protuberance 46 provide an interference fit due to the relative tapering of the protuberance 47 and the socket 44. The socket 44 and the protuberance 46 provide the two-part fastener 42 that provides retention and minimizes backlash of the first portion 24 of the safety 12 relative to the second portion 26 of the safety 12.

Figure 3A:
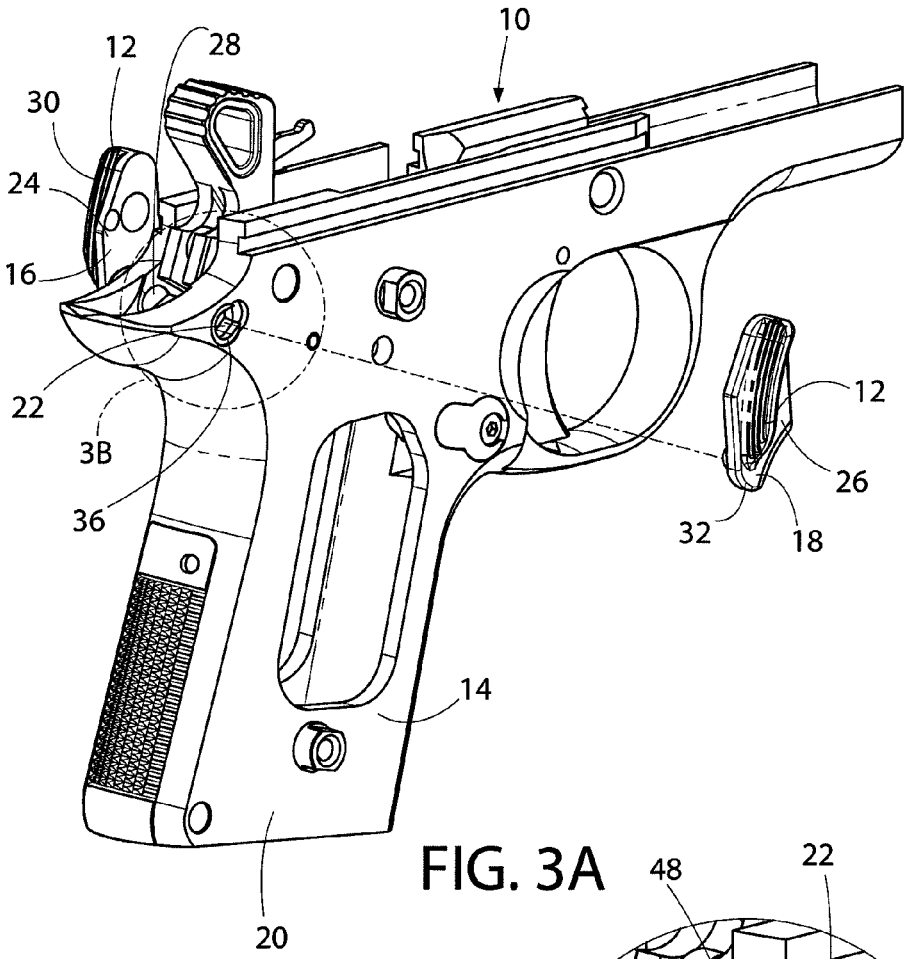
FIG. 3A is a side isometric view of the firearm of FIG. 1, with the slide, grips and other components removed for clarity, shown with one portion of the two-part safety disassembled.
Figure 3B:
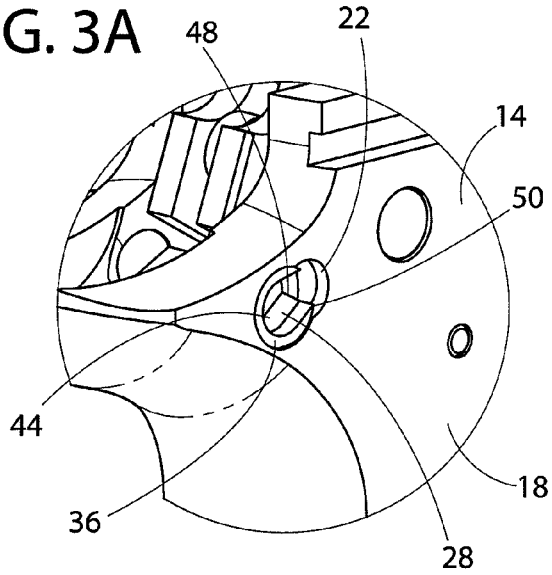
FIG. 3B is an enlarged detail view of the firearm of FIG. 3A, taken at detail 3B of FIG. 3A.
Figure 4:
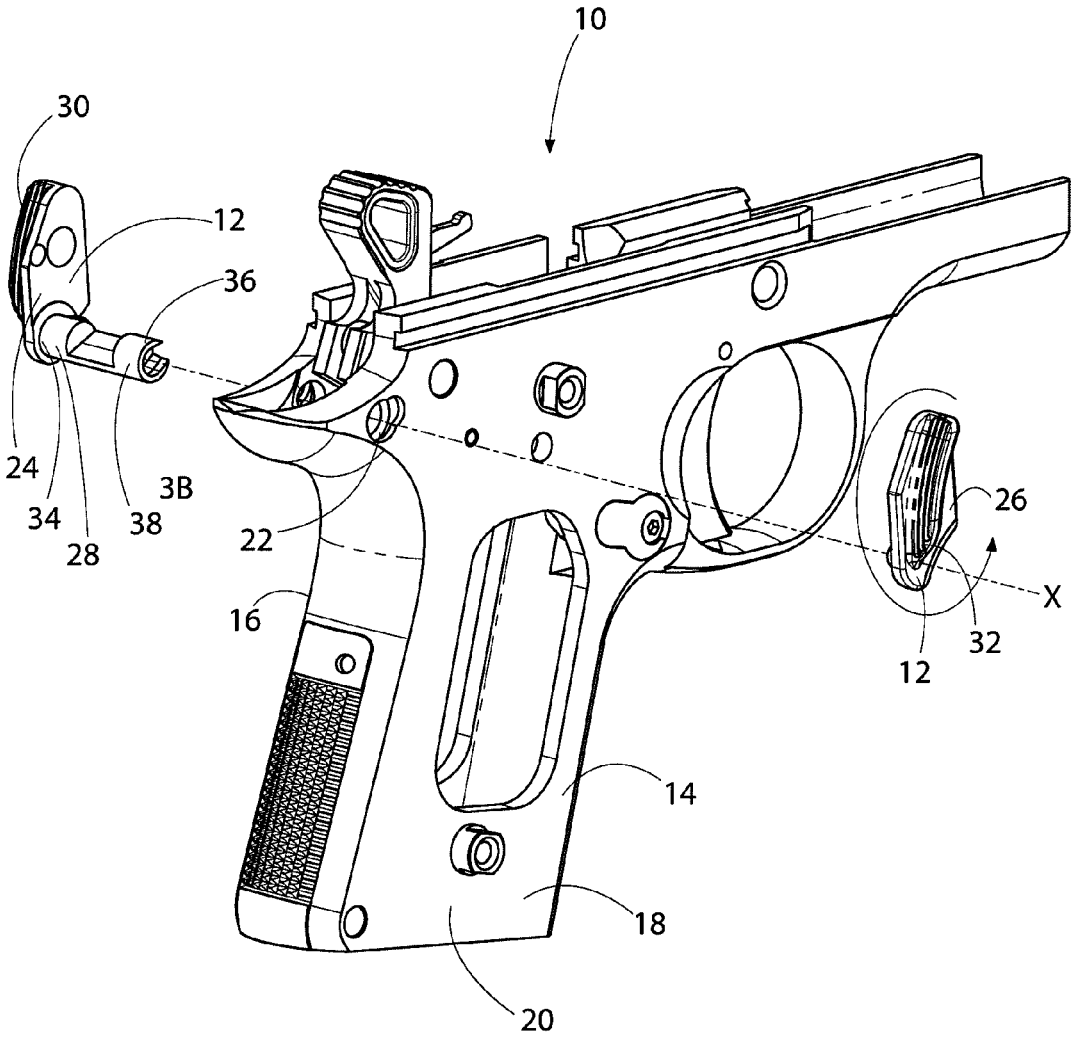
FIG. 4 is a side isometric view of the firearm of FIG. 1, with the slide, grips and other components removed for clarity, shown with both portions of the two-part safety disassembled.

Preferably, the aperture 22 in the frame 14 is keyed to the protuberance 46, as best seen in FIG. 3B. The aperture 22 allows assembly of the first portion 24 of the safety 12 with the second portion 26 of the safety, when aligned, as shown in FIG. 4. When the safety 12 is assembled in the frame 14 and rotated downward in the clockwise direction, the protuberance 46 prevents the safety 12 from being removed from the frame 12. The protuberance 46 rides in a slot cut into the frame 14 that captures the protuberance 46 and prevents disassembly of the safety 12 from the frame 14 until it is aligned as shown in FIG. 3B. The press fit (or interference fit) between the two portions 24, 26 of the safety 12 prevent backlash and provide some retention.

While the invention has been described in detail and with reference to specific embodiments thereof, it will be apparent to one skilled in the art that various changes and modifications can be made therein without departing from the spirit and scope thereof.

What is claimed is:

1. A firearm having an ambidextrous safety, comprising:

(a) a firearm frame having a left side, a right side, and a handle portion, said frame having a safety aperture, extending from the left side to the right side;

(b) the safety being rotatably disposed in said safety aperture, said safety comprising a first portion and a second portion and a pivot pin, each of said first portion and said second portion having a thumb lever rotatable relative to the frame about an axis of the pivot pin, said pivot pin disposed perpendicular to a plane of rotation of the thumb levers, said pivot pin having a first end and a second end, said first end integrally disposed on said first portion and said second end having a first part of a two-part fastener, said second portion having a second part of the two-part fastener, said fastener rigidly securing the first portion to the second portion through the aperture;

(c) one of said first part and said second part of said two-part fastener having a socket and the other of said first part and said second part of said two-part fastener having a protuberance for receipt in said socket;

(d) said protuberance extending from one of the thumb levers and being oblong in cross section in the plane of said one of the thumb levers and tapering inwardly away from said one of the thumb levers;

(e) said socket having a socket aperture having a tapered cutaway section, tapering inwardly toward the other one of the thumb levers for receipt of said protuberance;

(f) said socket and said protuberance providing an interference fit;

whereby said socket and said protuberance provide the two-part fastener that provides retention and minimizes backlash of the first portion relative to the second portion.

2. The ambidextrous safety of claim 1, wherein the aperture in the frame is keyed to the protuberance to retain the first and second portions of the safety in the frame.

* * * * *